US010274205B2

(12) United States Patent
Cecchin et al.

(10) Patent No.: US 10,274,205 B2
(45) Date of Patent: Apr. 30, 2019

(54) GAS COOKING APPLIANCE, MORE PARTICULARLY A GAS OVEN

(71) Applicant: LA CORNUE, Saint Ouen l'Aumone (FR)

(72) Inventors: Thomas Cecchin, Paris (FR); Eric Menegazzi, Lierville (FR)

(73) Assignee: LA CORNUE, Saint Ouen l'Aumone (FR)

( * ) Notice: Subject to any disclaimer, the term of this patent is extended or adjusted under 35 U.S.C. 154(b) by 615 days.

(21) Appl. No.: 14/950,782

(22) Filed: Nov. 24, 2015

(65) Prior Publication Data

US 2016/0153667 A1 Jun. 2, 2016

(30) Foreign Application Priority Data

Nov. 27, 2014 (FR) ..... 14 61566

(51) Int. Cl.
*F24C 15/32* (2006.01)
*F24C 3/02* (2006.01)
*F24C 3/08* (2006.01)

(52) U.S. Cl.
CPC ..... *F24C 15/32* (2013.01); *F24C 3/027* (2013.01); *F24C 3/087* (2013.01)

(58) Field of Classification Search
CPC ..... A47J 37/10; A47J 37/0623; F24C 15/10; H05B 3/68
See application file for complete search history.

(56) References Cited

U.S. PATENT DOCUMENTS

| | | | | |
|---|---|---|---|---|
| 993,241 | A | 5/1911 | Glover | |
| 1,168,857 | A | 1/1916 | Coes | |
| 1,239,341 | A | 9/1917 | Bird | |
| 2,086,223 | A | 7/1937 | Heidbreder | |
| 2,323,821 | A | 7/1943 | Lindemann et al. | |
| 2,839,044 | A * | 6/1958 | Phares | F24C 3/008 126/19 R |
| 9,635,979 | B2 * | 5/2017 | Abrams | A47J 37/0713 |

(Continued)

FOREIGN PATENT DOCUMENTS

| | | |
|---|---|---|
| EP | 2 184 545 A1 | 5/2010 |
| FR | 498 715 A | 1/1920 |
| GB | 174 759 A | 2/1922 |

(Continued)

OTHER PUBLICATIONS

FR Search Report, dated Apr. 15, 2014, from corresponding FR application.

*Primary Examiner* — Jorge A Pereiro
(74) *Attorney, Agent, or Firm* — Young & Thompson

(57) ABSTRACT

A cooking appliance includes a cooking chamber (11), the cooking chamber (11) including a bottom wall (12) and a top wall (13), and a gas burner (20) disposed under the bottom wall (12) of the cooking chamber (11). The bottom wall (12) includes an opening (12*a*) opposite the gas burner (20). The cooking appliance (10) includes a plate (30) disposed in the cooking chamber (11), above the gas burner (20), a space between the plate (30) and the bottom wall (12) forming a passage (34) for flow of the burnt gases coming from the gas burner (20). Use in particular for placing a receptacle (40) on the plate (30) and to obtain even cooking of the food by radiation, convection and conduction.

18 Claims, 5 Drawing Sheets

(56) References Cited

U.S. PATENT DOCUMENTS

| | | | | |
|---|---|---|---|---|
| 2003/0094169 | A1* | 5/2003 | Alden | A47J 37/067<br>126/25 R |

FOREIGN PATENT DOCUMENTS

| | | | |
|---|---|---|---|
| GB | 177 389 | A | 3/1922 |
| GB | 396 189 | A | 8/1933 |
| GB | 2 084 716 | A | 4/1982 |

* cited by examiner

GAS COOKING APPLIANCE, MORE PARTICULARLY A GAS OVEN

FIELD OF THE INVENTION

The present invention concerns a gas cooking appliance and more particularly a gas oven.

The invention generally relates to a cooking appliance for cooking food, for domestic or professional use.

BACKGROUND OF THE INVENTION

Such a cooking appliance comprises a cooking chamber comprising in known manner a bottom wall in the lower part and a top wall in the upper part A gas cooking appliance is equipped with a gas burner disposed under the bottom wall of the cooking chamber in order to obtain a rise in temperature in that cooking chamber, and to cook the food placed in that heated cooking chamber.

Gas cooking ovens are known, as described in the document FR 0 509 704, in which a flow of hot gas coming from a gas manifold is employed to cook food by convention and by radiation.

The flow of the burnt gases coming from the gas manifold is made through a double wall forming the cooking chamber.

The cooking chamber thus comprises, at the location of its side walls, a double wall opening into the lower part under the bottom wall of the cooking chamber, where the gas manifold is placed.

The burnt gases coming from the gas manifold rise along the space formed between the double wall of the cooking chamber and issue into the cooking chamber, by openings provided in the side walls, in the upper part, near the top wall.

The top wall guides the stream of burnt gases entering the interior of the cooking chamber and redirects that stream of burnt gases in a descending movement, into the lower part of the cooking chamber in order to cook the food by convection in particular.

The flow of the burnt gases enables regular and even cooking of the food to be obtained, without drying on account of the water vapor contained in the burnt gases.

This gas cooking oven however requires the creation of a double wall to enable the flow of the gases and the cooking by convection of the food.

SUMMARY OF THE INVENTION

The present invention is directed to improving such a cooking appliance and provides a gas cooking appliance having better energy efficiency.

To that end, the invention concerns a cooking appliance comprising a cooking chamber, the cooking chamber comprising a bottom wall and a top wall, and a gas burner disposed under the bottom wall of the cooking chamber.

According to the invention, the bottom wall comprises an opening opposite the gas burner and the cooking appliance comprises a plate disposed in the cooking chamber, above the gas burner, a space between the plate and the bottom wall forming a flow passage for the burnt gases coming from the gas burner.

The particular structure of the cooking chamber, thus equipped with a gas burner exposed by virtue of an opening provided for that purpose in the bottom wall and with a plate, makes it possible to create a flow of the burnt gases coming from the gas burner directly inside the cooking chamber, without requiring the creation of a double wall for flow of the burnt gases.

In addition to the simplification of the construction of the cooking chamber, the energy efficiency is improved by virtue of the direct flow of the burnt gases inside the cooking chamber, without energy loss at the double wall known from the prior art.

The direct use of the burnt gases coming from the gas burner enables a better energy efficiency to be obtained and thereby to reduce the energy consumption of the cooking appliance for a similar cooking performance.

Such a cooking appliance enables even heating and cooking of the food both by radiation and by convection.

The direct contact between the food and the burnt gases charged with water vapor enables the evaporation during cooking of the food to be limited and thus to reduce the weight loss of the food during cooking.

According to an embodiment, the plate comprises a peripheral rim extending towards the bottom wall of the cooking chamber, the peripheral rim comprising two cut-outs respectively forming two flow passages for the burnt gases.

According to a feature, the cooking chamber comprises two side walls, the two cut-outs respectively forming two flow passages for the burnt gases opening between the plate and the bottom wall respectively facing the side walls of the cooking chamber.

The two flow passages for the burnt gases formed by the cut-outs thus open in opposite situation into the cooking chamber, the burnt gases being guided by the side walls of the cooking chamber to the top wall.

Advantageously, the cooking chamber comprises a curved top wall, the curvature of the top wall extending from one side wall to the other side wall.

The curved form of the top wall promotes the orientation of the burnt gases in the cooking chamber and their movement in vortices in the cooking chamber.

According to an advantageous embodiment, the plate has a back wall facing the gas burner, the back wall being chamfered such that the distance between a central part of the back wall and the plane of the bottom wall is less than the distance between a zone of the back wall near the cut-outs and the plane of the bottom wall.

This chamfered form of the back wall makes it possible to guide the stream of burnt gases exiting the gas burner to the cut-outs of the peripheral rim of the plate.

In an embodiment of the cooking appliance, the plate is formed from cast iron, preferably enameled cast iron.

The plate thus has high thermal inertia. Such a plate is particularly adapted to constitute a hotplate inside the cooking chamber on which a dish containing the food to cook may be directly placed.

In this case, the cooking appliance advantageously combines heating of the food by conduction, with heating by radiation and convection described above.

Such a cooking appliance in particular enables slow cooking or cooking by simmering of the food.

By virtue of the burnt gases coming from the gas burner and escaping via the opening in the bottom wall of the cooking chamber around the plate, even heating of the food placed in a receptacle directly on the plate is obtained, by virtue of the flow of the burnt gases in the space around that plate.

Thus, according to a second aspect, the invention concerns the use of a cooking appliance as described above, a cooking receptacle being placed on the plate in contact therewith.

Still other particularities and advantages of the invention will appear in the following description.

BRIEF DESCRIPTION OF THE DRAWINGS

In the accompanying drawings, given by way of non-limiting example.

DETAILED DESCRIPTION OF THE INVENTION

An example embodiment of a gas cooking appliance will first of all be described.

Such a cooking appliance may be a gas oven for domestic or professional use, for cooking and/or heating food.

Figure 1:
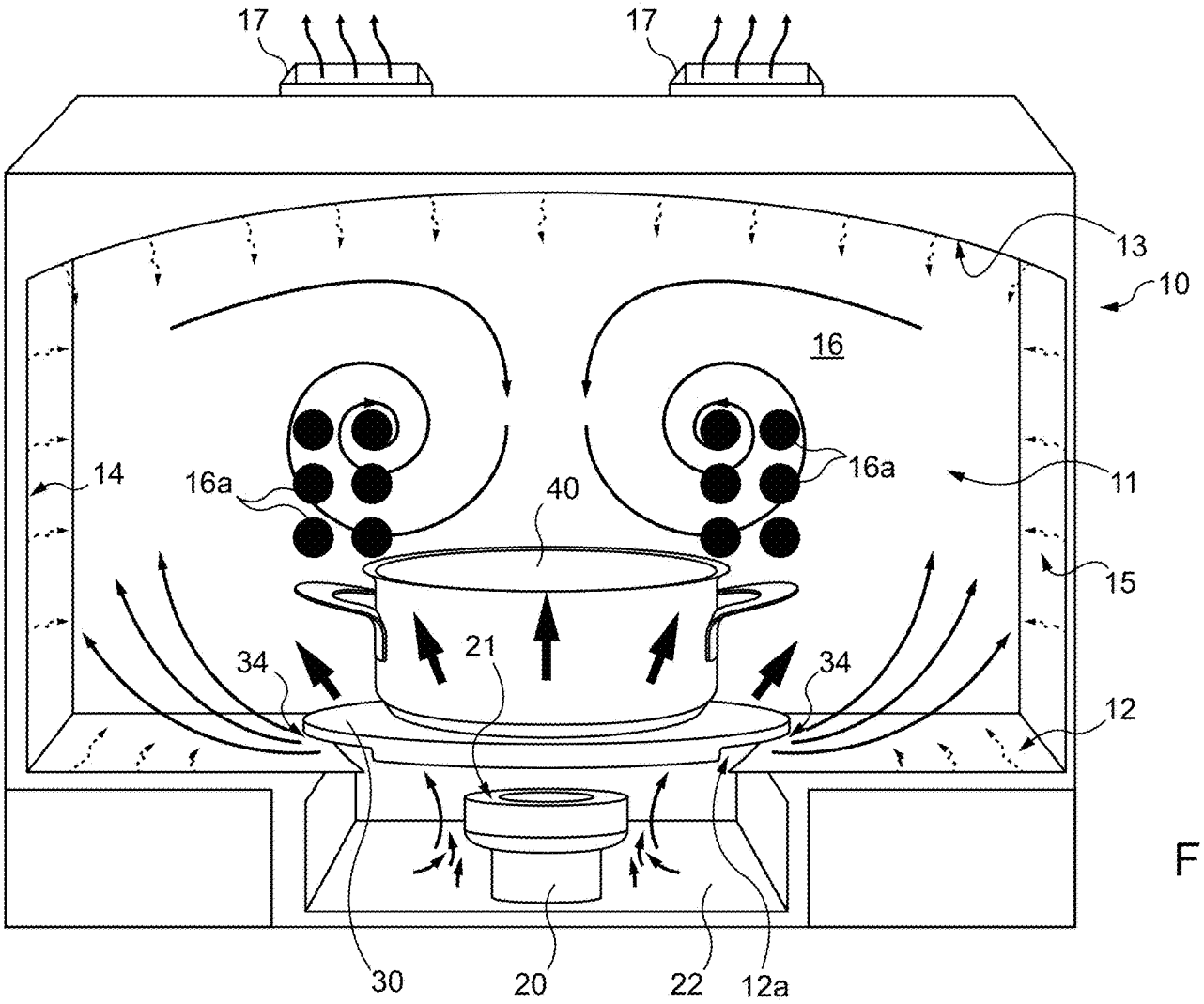
FIG. 1 is a diagrammatic perspective view of cooking appliance according to an embodiment of the invention.
Figure 2:
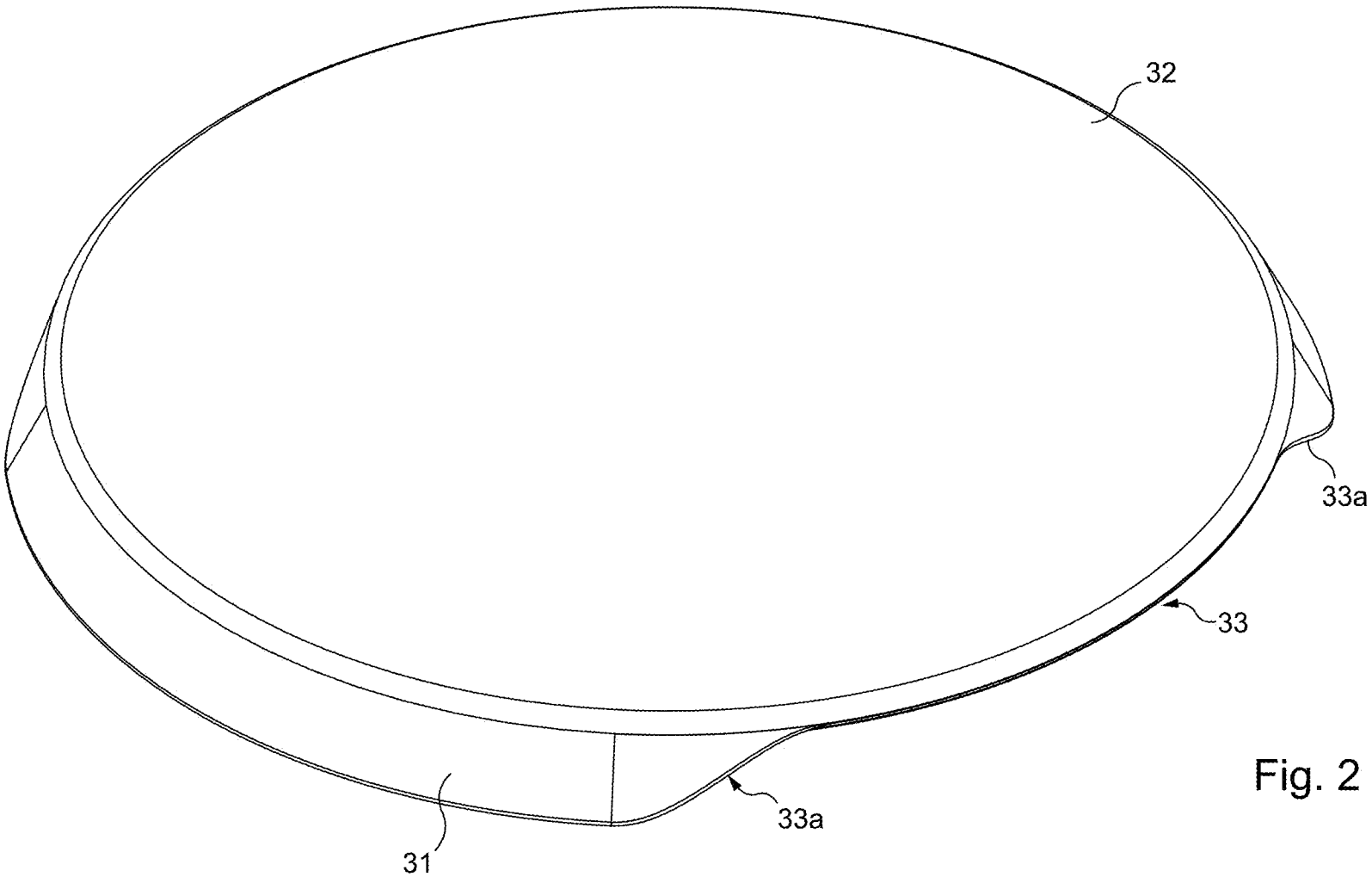
FIG. 2 is a perspective view of plate example implemented in the cooking appliance of FIG. 1.
Figure 3:
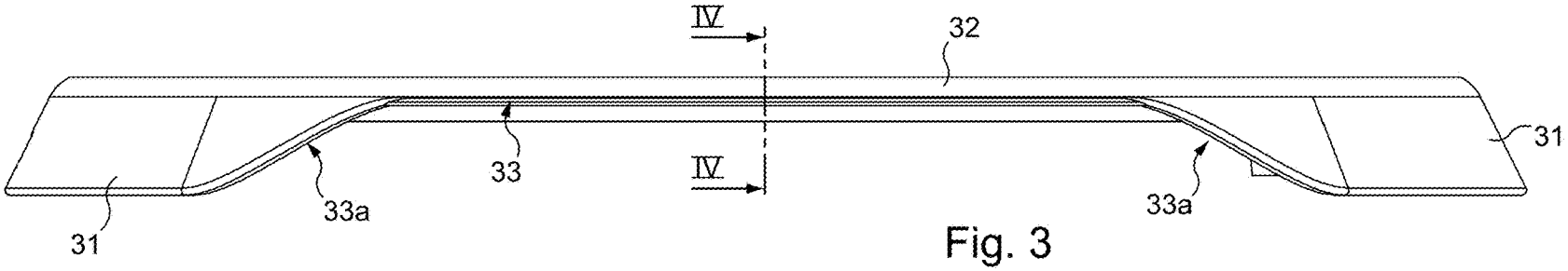
FIG. 3 is a side view of the plate of FIG. 2.

As illustrated in FIG. 1, the cooking appliance 10 comprises a cooking chamber 11 configured to receive food to cook and/or to heat.

In known manner, the food is placed for example in a dish, set down on a rack or a plate held in the cooking chamber by means of support rails (not shown) of the cooking chamber.

The cooking chamber 11 comprises a bottom wall 12 in the lower part and a top wall 13 in the upper part.

The cooking chamber 11 comprises two side walls 14, 15, the top wall 13 extending between the two side walls 14, 15.

Here, in non-limiting manner, the top wall 13 is curved, thus having a concave shape directed towards the inside of the cooking chamber 11.

The top wall thus has a curvature in the vertical plane perpendicular to the side walls 14, 15. The curvature of the top wall 13 forms a circle arc. It extends from one side wall 14 to the other side wall 15.

The cooking chamber 11 also comprises a back wall 16 which, in known manner, is opposite an opening for introduction of food, closed by a door (not shown in FIG. 1).

The cooking appliance 10 also comprises a gas burner 20 disposed under the bottom wall 12 of the cooking chamber 11.

In this embodiment and in a way that is in no way limiting, the gas burner 20 is a circular burner, equipped with a ring.

By way of example, the diameter of the ring 21 of the gas burner 20 may be substantially equal to 80 cm.

As clearly illustrated in FIG. 1, the gas burner 20 is disposed in a lower part 22 of the bodywork of the cooking appliance, under the bottom wall 12 of the cooking chamber 11.

The cooking appliance of course comprises components that are well-known to the person skilled in the art to supply the gas burner 20 with gas. These components are not illustrated in FIG. 1 and do not need to be described here in relation with the invention.

The bottom wall 12 comprises an opening 12*a* opposite the gas burner.

The opening 12*a* is formed for example by cutting out from a metal sheet forming the bottom wall 12.

In this embodiment, and in non-limiting manner, the opening 12*a* of the bottom wall 12 is of circular shape.

This opening 12*a* is disposed substantially in the center of the bottom wall 12 and thus of the cooking chamber 11.

If the gas burner 20 as described above also has a circular shape, the diameter of the opening 12*a* of the bottom wall is greater than the diameter of the ring 21 of the gas burner 20.

In the example described above, and in non-limiting manner, the opening 12*a* of the bottom wall 12 is of diameter substantially equal to 250 mm.

The burner 20 is thus exposed and visible through the opening 12*a* of the bottom wall 12 in the cooking chamber 11.

The cooking appliance 10 further comprises a plate 30 disposed in the cooking chamber 11, above the gas burner 20.

In the embodiment illustrated in FIG. 1, the plate 30 is of circular shape and extends coaxially with the opening 12*a* in the bottom wall 12 and the gas burner 20.

The plate 30 is illustrated in more detail in FIGS. 2 to 5.

In this embodiment, the plate 30 comprises a substantially planar portion 32 provided with a peripheral rim 31. The peripheral rim 31 extends for example substantially perpendicularly or in an inclined plane relative to the substantially planar portion 32.

As clearly illustrated in FIG. 1, the peripheral rim 31 extends towards the bottom wall 12 of the cooking chamber 11.

In a practical embodiment of the invention, the plate 30 has a greater diameter than the diameter of the opening 12*a* of the bottom wall 12.

By way of example, the diameter of the plate 30 is approximately 290 mm.

The plate 30 is thus positioned above the opening 12*a* in the bottom wall 12 so as to form a space between the plate 30 and the bottom wall 12 to create a flow passage for the burnt gases coming from the gas burner 20.

By way of non-limiting example, the positioning of the plate 30 on the bottom wall 12 is made via positioning projections.

Figure 5:
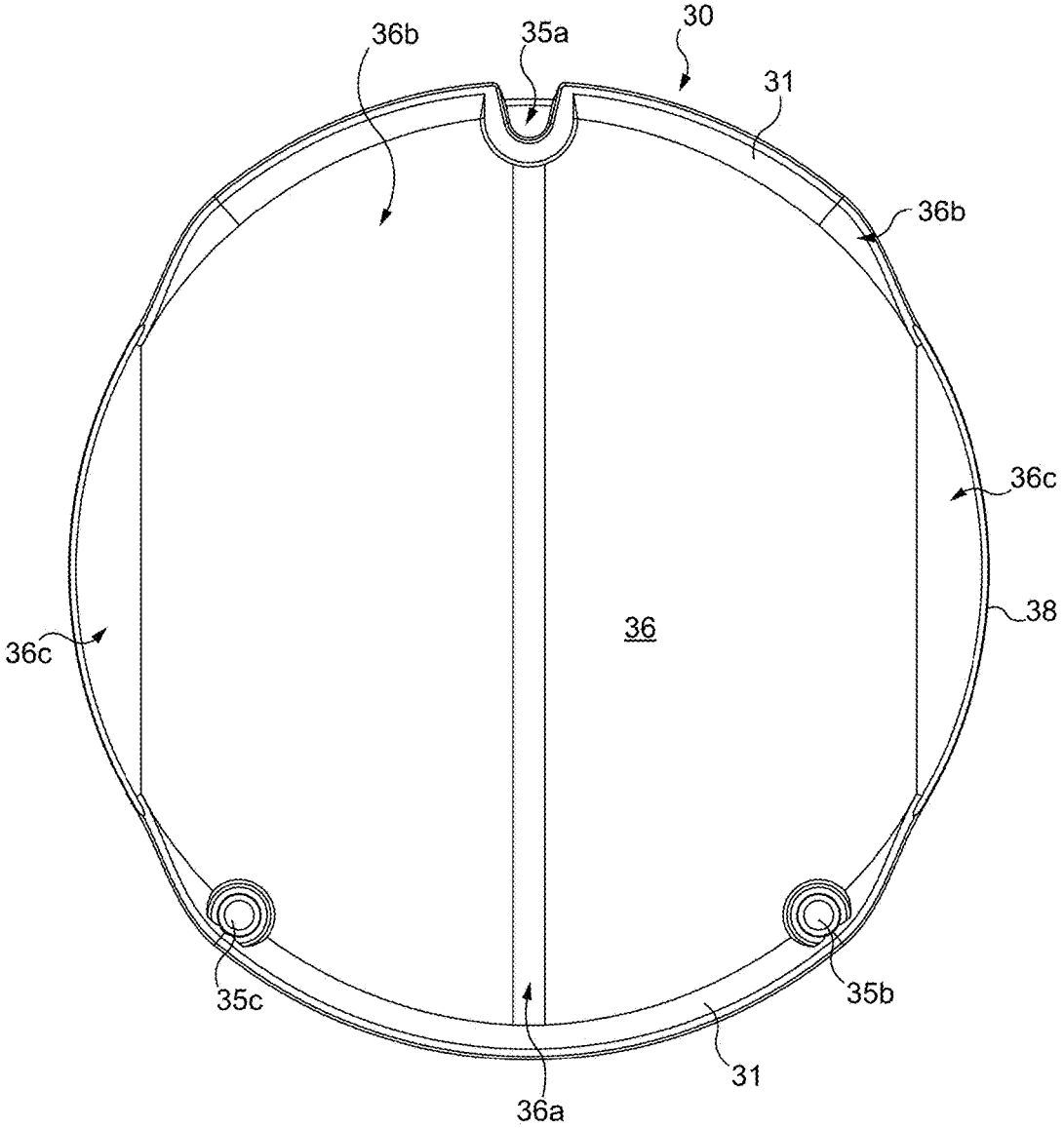
FIG. 5 is a view from below of the plate of FIG. 2.

As clearly illustrated in FIG. 5, the plate 30 comprises three housings 35*a*, 35*b*, 35*c* configured to cooperate to house positioning projections (not shown) provided for that purpose on the bottom wall 12 of the cooking chamber 10.

The use of positioning projections enables the orientation of the plate 30 in the cooking chamber 10 to be indexed reliably.

The use of three positioning projections enables stable positioning and unique indexing of the plate 30 on the bottom wall 12 of the cooking chamber.

As will become apparent in the following description, this unique positioning of the plate 30 in the cooking chamber 10 promotes the flow of the burnt gases coming from the gas burner through the passage formed between the plate 30 and the bottom wall 12.

In this embodiment and in non-limiting manner, a first housing 35*a* is provided on an edge of the plate 30 configured to be positioned towards the rear of the bottom wall 12, near the back wall 16 of the cooking chamber 10.

The first housing 35*a* has a semi-cylindrical shape which is open to the outside of the plate 30 in order to enable the positioning of the plate and a slight rotation of the plate 30 around a first positioning projection configured to be housed in the first housing 35*a*.

By virtue of the pivoting obtained at that point, the plate 30 may be positioned without difficulty to place the other two housings 35*b*, 35*c* facing the other positioning projections provided for that purpose towards the front of the bottom wall 12 of the cooking chamber 10, that is to say near the opening of the oven door.

The positioning of the plate 30 above the bottom wall 12 and the holding of that plate 30 above the bottom wall 12 by virtue of positioning projections makes it possible to leave a space free between the plate 30 and the bottom wall 12 for the flow of the burnt gases coming from the gas burner 20.

As clearly illustrated in FIGS. 2 to 5, the peripheral rim 31 comprises two cut-outs 33.

The two cut-outs 33 thus respectively form two flow passages 34 for the burnt gases.

The peripheral rim 31 of the plate 30 is preferably chamfered at the ends 33*a* of the cut-outs 33.

The cut-outs 33 are thus linked, at their end 33*a*, by a beveled edge to the peripheral rim 31.

These chamfers formed at the ends 33*a* of the cut-outs 33 make it possible to avoid the presence of sharp edges at the location of the peripheral rim 31 and facilitate the production by casting of the plate 30.

In the embodiment illustrated in FIGS. 2 to 5, the plate 30 comprises cut-outs 33 each extending substantially over a quarter of the perimeter of the peripheral rim 31.

As clearly illustrated in FIG. 5, the plate 30 has a back wall 36 configured to be disposed facing the gas burner 20.

Figure 4A:
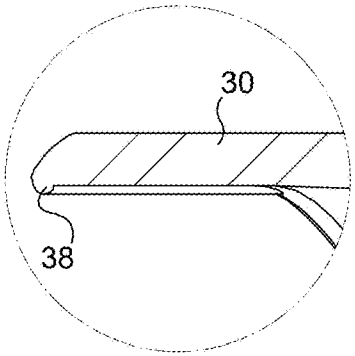
FIG. 4A is an enlarged detail of FIG. 4B.
Figure 4B:
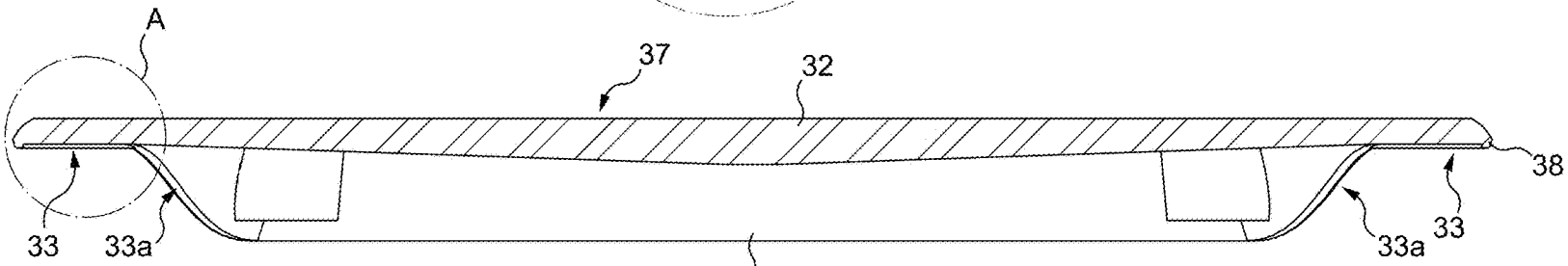
FIG. 4B is a section view on line IV-IV of FIG. 3.

As visible in FIGS. 4A, 4B and 5, the back wall 36 is chamfered.

More particularly the back wall 36 comprises a central part 36*a* extending substantially the length of a diameter of the plate 30 and forming a planar part, substantially parallel to an outer planar wall 37 of the plate 30. The central part 36*a* extends between the peripheral rim 31 of the plate 30 and the first housing 35*a* described above.

Starting from that central part 36*a*, the back wall 36 has two chamfered parts 36*b* thus forming two inclined planes relative to the plane of the outer planar wall 37 of the plate 30.

The chamfered parts 36*b* thus extend towards the peripheral rim 31 provided with the cut-outs 33.

At the location of these cut-outs 33, the two chamfered parts 36*b* are respectively connected to two planar edge portions extending along the edge of the plate 30, in a zone 36*c* of the back wall 36 close to the cut-outs 33 of the peripheral rim 31.

Figure 6:
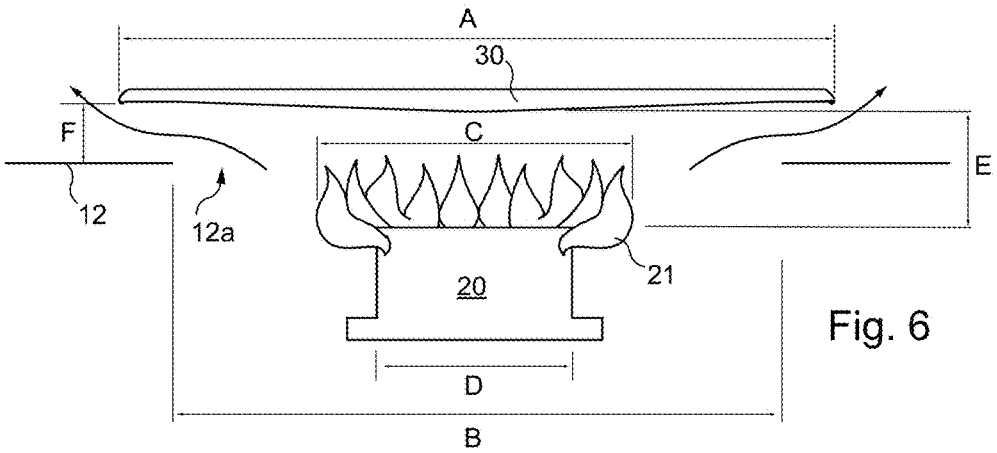
FIG. 6 is an explanatory diagram of the relative positioning of the components of a cooking appliance according to a non-limiting example embodiment.

Thus, as illustrated in FIG. 6, the distance between the central part 36*a* of the back wall 36 and the plane of the bottom wall 12 is less than the distance between the plane of the bottom wall 12 and the zone of the back wall 36 near the cut-outs 33.

As clearly illustrated in FIG. 1, the flow passages 34 for burnt gases formed by the cut-outs 33 open between the plate 30 and the bottom wall 12 respectively facing the side walls 14, 15 of the cooking chamber 11.

Thus, in the embodiment described here, the substantially planar portion 32 of the plate 30 extends opposite the gas burner 20 and the peripheral rim 31 extends towards the bottom wall 12 of the cooking chamber 11, the central part 36*a* of the back wall being disposed substantially parallel to the side walls 14, 15.

In this position, the two cut-outs 33 respectively form two flow passages 34 for the burnt gases each opening facing the side walls 14, 15 of the cooking chamber.

As clearly illustrated in FIG. 4A the edge of the plate 30 has at the location of the cut-outs 33 a tumescence 38 forming a projection on the back wall 36 of the plate 30.

The tumescence 38 on the edge of the plate 30 plays the role of a drip edge and makes it possible to avoid liquids present on the upper face 37 of the plate 30 flowing along the back wall 36 and falling onto the gas burner 20.

The back wall 16, which extends between the bottom wall 12 and the top wall 13 of the cooking chamber 11 comprises apertures 16*a* constituting outlet apertures for the burnt gases from cooking the chamber 11.

In this embodiment, and in non-limiting manner, the back wall 16 comprises two series of apertures 16*a*, each series opening into a pipe forming a chimney 17 extending behind the back wall 16 of the cooking chamber 11, and thus at the back of the cooking appliance 10.

With reference to FIG. 6 an example of relative positioning of the various components in the cooking chamber 10 will now be described.

In this embodiment, the gas burner is a ring burner, of diameter D for example equal to 80 mm.

This gas burner 20 thus has a ring of flames of which the diameter C depends on the rated power.

As indicated earlier, the opening 12*a* of the bottom wall 12 has a diameter B greater than the diameter D of the ring 21 of the gas burner 20.

Preferably, the diameter B of the opening 12*a* must also be greater than the diameter C of the ring of flames in order to protect the bottom wall 12 from overheating and a direct contact with the flame, whatever the rated power of the gas burner 20.

Thus, the diameter B of the opening 12*a* of the bottom wall 12 is for example substantially equal to twice the maximum diameter C of the maximum ring of flames.

By way of non-limiting example, the diameter B of the opening 12*a* of the bottom wall 12 may be comprised between 200 and 300 mm.

Furthermore, the diameter A of the plate 30 is greater than the diameter B of the opening 12*a* of the bottom wall 12.

The diameter A of the plate 30 may thus be comprised between 250 and 350 mm.

As clearly illustrated in FIG. 6, the positioning of the plate 30 above the bottom wall 12 and of the gas burner 20 is made such that a distance E is formed between the ring 21 of the gas burner 20 and the plate 30 and a distance F is formed between the plane of the bottom wall 12 and the plate 30.

The distance E between the ring 21 of the gas burner 20 and the plate 30 depends on the distance required by construction, in order to obtain good combustion.

According to the flow rate of the burnt gases, based on the rated power of the gas burner 20, the distance E must be sufficient to avoid any re-circulation of the burnt gases towards the gas burner 20.

By way of non-limiting example, the distance E is for example greater than or equal to 40 mm.

The distance F measured more precisely between the plane of the bottom wall 12 and the zone 36*c* of the back wall 36 at the location of the cut-outs 33 must be sufficient to enable the flow of the burnt gases illustrated by an arrow at FIG. 6.

Given the direction of the flames exiting the ring 21 of the burner 20, thus forming an angle relative to the plate 30, the burnt gases are oriented in an inclined direction relative to the plate 30 and not directly perpendicular to the plate 30.

The perpendicular shock of the burnt gases on the back wall 36 of the plate 30, which could adversely affect the combustion, is thus avoided.

High heat energy would then be consumed by the plate 30 to the detriment of the flow of the burnt gases in the cooking chamber 10.

Here, and solely by way of example, approximately 90% of the heat emitted by the gas burner 20 is consumed to heat the cooking chamber and approximately 10% to heat the plate 30.

The chamfered form of the back wall 36 of the plate 30 enables smoothing and continuity in the orientation of the burnt gases escaping mainly by the cut-outs 33 of the peripheral rim 31 of the plate 30.

By way of non-limiting example, the distance F between the zone 36*c* of back wall 36 at the location of the cut-outs 33 and the plane of the bottom wall 12 is of the order of 25 mm.

Furthermore, the distance between the plane of the bottom wall 12 and the peripheral rim 31 of the plate 30, outside of the parts bearing the cut-outs 33, is of the order of 5 mm making it possible to create a flow passage for the burnt gases all around the plate 30.

With reference to FIG. 1 the operation of the cooking appliance 10 will now be described, and in particular the flow of the burnt gases coming from the gas burner 20 during the cooking of the food.

As clearly illustrated by the arrows in fine line, the burnt gases, mainly corresponding to the burnt gases escaping from the gas burner 20, pass through the passage 34 at the location of the space formed between the plate 30 and the bottom wall 12 of the cooking chamber 11.

It should be noted that the burnt gases escape all around the plate 30 in the space formed between the plate 30 and the bottom wall 12, although preferential flow is created at the location of the cut-outs 33 of the peripheral rim 31 of the plate 30.

The burnt gases rise under the effect of the heat against the side walls 14, 15 towards the top wall 13 of the cooking chamber 11.

The curved form of the top wall 13 guides the burnt gases so as to direct the stream of burnt gases in a descending movement to the center of the cooking chamber 11, towards the food placed in the cooking chamber 11.

The curved shape of the top wall 13 thus makes it possible to promote the flow of the burnt gases inside the cooking chamber 10.

More particularly, the burnt gases escape mainly in symmetrical manner from the passages 34 formed by the cut-outs 33 of the peripheral rim 31 of the plate 30 along the side walls 14, 15 and meet at the central point of the top wall 13.

These gases are thus forced, while swirling, to descend back towards the food placed in the center of the cooking chamber 10, for example onto a rack (not shown) slid into support rails of the cooking chamber 11.

The burnt gases thus flow around the food, swirling until they are evacuated by the outlet apertures 16*a* provided in the back wall 16 of the cooking chamber 11 and their extraction from the cooking appliance 10 by the chimneys 17.

The cooking appliance 10 thus described makes it possible to promote a flow of the burnt gases within the cooking chamber 11, and thus to obtain even cooking of the food by convection.

The flow of the burnt gases within the cooking chamber 11 also enables a rise in temperature of the walls of the cooking chamber, that is to say of the bottom wall 12, of the top wall 13, of the side walls 14, 15 and of the back wall 16.

These heated walls thus emit heat by radiation (represented by the arrows in dashed line) towards the food to cook.

The cooking of the food is thus advantageously obtained by combining both heating by radiation and heating by convection.

The direct use of the burnt gases within the cooking chamber makes it possible to obtain good energy efficiency for the cooking appliance.

The plate 30 may furthermore advantageously be produced from cast iron, for example from enameled cast iron.

In an embodiment, the food to cook may be contained in a cooking dish or receptacle 40 placed directly in contact on the plate 30.

The plate 30 thus plays the role of a firewall plate conventionally used in gas cooking ranges and constitutes a hotplate within the actual interior of the cooking chamber 11 of the cooking appliance 10.

As clearly illustrated by the arrows in thick dashed line, the food may thus equally cook by conduction, by the heat transmitted by the plate in direct contact with the flames of the gas burner 20.

The use of a plate 30 of cast iron, having a high thermal inertia, also enables a large temperature drop inside the cooking chamber 11 to be avoided on opening the door of the cooking appliance 10.

The use of a plate 30 of cast iron, on account of the thermal inertia of that material, enables a rise in temperature of the plate 30 simultaneously with the rise in temperature of the cooking chamber 11.

The enameled cast iron furthermore enables the plate 30 to better withstand impacts and soiling, in particular when the plate 30 is configured directly to receive a container for the cooking of the food.

In such a cooking appliance with a plate 30 of cast iron, the cooking of the food advantageously combines cooking by conduction, radiation and convection.

Of course, the invention is not limited to the example embodiments described above.

In particular, it is possible for the shape of the opening, of the gas burner and of the plate not to be circular. The gas burner may be composed of a straight bar for example.

Furthermore, the plate 30 may be produced in other types of material such as in aluminum or in steel.

Furthermore, the shape of the cooking chamber 11 may be different, and in particular the top wall 13 of the cooking appliance may be planar.

The cooking appliance described above thus enables a gas oven to be produced having improved energy conversion and efficiency.

The invention claimed is:

1. A cooking appliance, comprising:

a cooking chamber (11), the cooking chamber (11) comprising a bottom wall (12) and a top wall (13); and a gas burner (20) disposed under the bottom wall (12) of the cooking chamber (11), the bottom wall (12) comprising an opening (12*a*) opposite said gas burner (20) and the cooking appliance (10) comprises a plate (30) disposed in the cooking chamber (11), above said gas burner (20), wherein a space between the plate (30) and the bottom wall (12) forms a flow passage (34) for the burnt gases coming from the gas burner (20), said space being located all around said plate (30), and wherein said plate (30) comprises a peripheral rim (31) extending towards the bottom wall (12) of the cooking chamber (11), said peripheral rim (31) comprising two cut- outs (33) respectively forming two preferential flow passages (34) for the burnt gases.

2. The cooking appliance according to claim 1, wherein the cooking chamber (11) comprises two side walls (14, 15), said two cut-outs respectively forming two flow passages (34) for the burnt gases opening between the plate (30) and the bottom wall (12) respectively facing the side walls (14, 15) of the cooking chamber (11).

3. The cooking appliance according to claim 2, wherein the cooking chamber (11) comprises a curved top wall, the curvature of the top wall extending from one of said two side walls (14, 15) to the other of said two side walls (14, 15).

4. The cooking appliance according to claim 3, wherein the plate (30) has a back wall (36) facing said gas burner (20), the back wall (36) being chamfered such that the distance between a central part (36*a*) of the back wall (36) and the plane of the bottom wall (12) is less than the distance between a zone (36*c*) of the back wall (36) near the cut-outs (33) and the plane of the bottom wall (12).

5. The cooking appliance according to claim 3, wherein the cooking chamber (11) comprises a back wall (16) extending between the bottom wall (12) and the top wall (13), said back wall (16) comprising outlet apertures (16*a*) for the burnt gases from the cooking chamber (11).

6. The cooking appliance according to claim 2, the plate (30) has a back wall (36) facing said gas burner (20), the back wall (36) being chamfered such that the distance between a central part (36*a*) of the back wall (36) and the plane of the bottom wall (12) is less than the distance between a zone (36*c*) of the back wall (36) near the cut-outs (33) and the plane of the bottom wall (12).

7. The cooking appliance according to claim 2, wherein the cooking chamber (11) comprises a back wall (16) extending between the bottom wall (12) and the top wall (13), said back wall (16) comprising outlet apertures (16*a*) for the burnt gases from the cooking chamber (11).

8. The cooking appliance according to claim 1, wherein the plate (30) has a back wall (36) facing said gas burner (20), the back wall (36) being chamfered such that the distance between a central part (36*a*) of the back wall (36) and the plane of the bottom wall (12) is less than the distance between a zone (36c) of the back wall (36) near the cut-outs (33) and the plane of the bottom wall (12).

9. The cooking appliance according to claim 8, wherein the cooking chamber (11) comprises a back wall (16) extending between the bottom wall (12) and the top wall (13), said back wall (16) comprising outlet apertures (16*a*) for the burnt gases from the cooking chamber (11).

10. The cooking appliance according to claim 1, wherein said plate (30) is of circular shape.

11. The cooking appliance according to claim 10, wherein the opening (12*a*) of said bottom wall (12) is of circular shape, of diameter greater than the diameter of a ring (21) of the gas burner (20) and less than the diameter of the plate (30).

12. The cooking appliance according to claim 11, wherein the cooking chamber (11) comprises a back wall (16) extending between the bottom wall (12) and the top wall (13), said back wall (16) comprising outlet apertures (16*a*) for the burnt gases from the cooking chamber (11).

13. The cooking appliance according to claim 10, wherein the cooking chamber (11) comprises a back wall (16) extending between the bottom wall (12) and the top wall (13), said back wall (16) comprising outlet apertures (16*a*) for the burnt gases from the cooking chamber (11).

14. The cooking appliance according to claim 1, wherein the plate (30) is produced from cast iron.

15. The cooking appliance according to claim 14, wherein the cooking chamber (11) comprises a back wall (16) extending between the bottom wall (12) and the top wall (13), said back wall (16) comprising outlet apertures (16*a*) for the burnt gases from the cooking chamber (11).

16. The cooking appliance according to claim 14, wherein the plate (30) is produced from enameled cast iron.

17. The cooking appliance according to claim 1, wherein the cooking chamber (11) comprises a back wall (16) extending between the bottom wall (12) and the top wall (13), said back wall (16) comprising outlet apertures (16*a*) for the burnt gases from the cooking chamber (11).

18. A method of cooking food contained in a receptacle (40), which comprises: providing a cooking appliance according to claim 1; and placing the receptacle (40) directly on said plate (30) in contact therewith.

* * * * *